US005474511A

United States Patent [19]

Dantolan

[11] Patent Number: 5,474,511

[45] **Date of Patent: *Dec. 12, 1995**

[54] RECIPROCATING WEIGHT EXERCISE DEVICE

[76] Inventor: Harry E. Dantolan, 11045 S. Spaulding, Chicago, Ill.

[ * ] Notice: The term of this patent shall not extend beyond the expiration date of Pat. No. 5,334,118.

[21] Appl. No.: 175,745

[22] Filed: Dec. 30, 1993

Related U.S. Application Data

[63] Continuation-in-part of Ser. No. 532,602, Jun. 4, 1990, Pat. No. 5,334,118, which is a continuation-in-part of Ser. No. 355,661, May 22, 1989, abandoned.

[51] Int. Cl.[6] ..... A63B 21/05; A63B 21/06

[52] U.S. Cl. ..... 482/93; 482/109; 482/110; 482/121; 482/128

[58] Field of Search ..... 482/91–94, 98, 482/99, 101, 104, 109, 110, 121, 122, 126–129, 132, 133, 908

[56] References Cited

U.S. PATENT DOCUMENTS

| | | | |
|---|---|---|---|
| 647,220 | 4/1900 | Courtney | 482/109 |
| 818,242 | 4/1906 | Geisel . | |
| 1,956,498 | 4/1934 | Duke . | |
| 2,528,213 | 10/1950 | Dantolan . | |
| 2,714,008 | 7/1955 | Urban . | |
| 2,920,418 | 1/1960 | Britt . | |
| 3,544,106 | 12/1970 | Barrett . | |
| 3,545,121 | 12/1970 | Misko | 446/486 |
| 3,761,083 | 9/1973 | Buchner . | |
| 3,938,803 | 2/1976 | Wilmoth et al. . | |
| 4,623,146 | 11/1986 | Jackson . | |
| 4,775,149 | 10/1988 | Wilson | 482/126 |
| 4,809,975 | 3/1989 | Lee | 482/109 |
| 5,334,118 | 8/1994 | Dantolan | 482/93 |

FOREIGN PATENT DOCUMENTS

| | | | |
|---|---|---|---|
| 0084925 | 5/1920 | Switzerland | 482/128 |
| 0161282 | 4/1921 | United Kingdom | 482/126 |

*Primary Examiner*—Richard J. Apley
*Assistant Examiner*—Victor K. Hwang
*Attorney, Agent, or Firm*—Willian Brinks Hofer Gilson & Lione

[57] ABSTRACT

An exercise device is provided that is useful for exercising various muscle groups of the body including the arms, shoulders, upper and lower back, abdomen, and to a certain extent the legs. The device comprises a rod that has a sliding weight. The sliding action of the weight is restricted or dampened by springs. To exercise with this device one holds the rod and causes the weight to slide back and forth along the length of the rod.

6 Claims, 3 Drawing Sheets

RECIPROCATING WEIGHT EXERCISE DEVICE

This application is a continuation-in-part of application Ser. No. 07/532,602, which was filed on Jun. 4, 1990 and issued on Aug. 2, 1994 as U.S. Pat. No. 5,334,118 and, which was a continuation-in-part of application Ser. No. 07/355,661, which was filed on May 22, 1989, and which is now abandoned.

FIELD OF THE INVENTION

The invention is related to bar-bell type exercise devices and is particularly directed to an exercise device having reciprocating weights.

BACKGROUND OF THE INVENTION

The present invention is an advance in the art of exercise devices and is an improvement in the type of the exercise device disclosed in U.S. Pat. No. 2,528,213, issued to Wilfred V. Dantolan on Oct. 31, 1950, the teachings of which are hereby incorporated by reference. The invention comprises a rigid rod with a sliding weight the movement of which is restrained along the entire length of the rod by springs. The rod has handles at one or both ends. To use the invention one holds the rod by the handles and causes the weight to slide back and forth along the length of the rod. The invention enables one to exercise various portions of the body including the arms, shoulders, upper and lower back, abdomen, and to a certain extent the legs.

SUMMARY OF THE INVENTION

A particular feature of this invention is to provide a reciprocating weight exercise device. A further feature of this invention is to provide a substantially uniform force to the user that is substantially free from jarring or percussive forces.

According to the invention a reciprocating weight exercise device is provided which comprises a rigid rod having a first and a second end. A handle is attached to the first end of this rod. A weight is on the rod and is adapted for sliding movement along the rod. A means for restricting the sliding movement of the weight along the entire length of the rod is provided so that when the weight is slid back and forth along the rod in a direction parallel to the length of the rod a user will feel a substantially uniform force from the sliding movement of the weight and so that a user will feel a force substantially free from jarring forces from the sliding movement of the weight.

To aid in understanding the invention one is directed towards the drawings and the detailed description of the present preferred embodiment of the invention.

DETAILED DESCRIPTION OF PRESENTLY PREFERRED EMBODIMENT OF THE INVENTION

Figure 1:
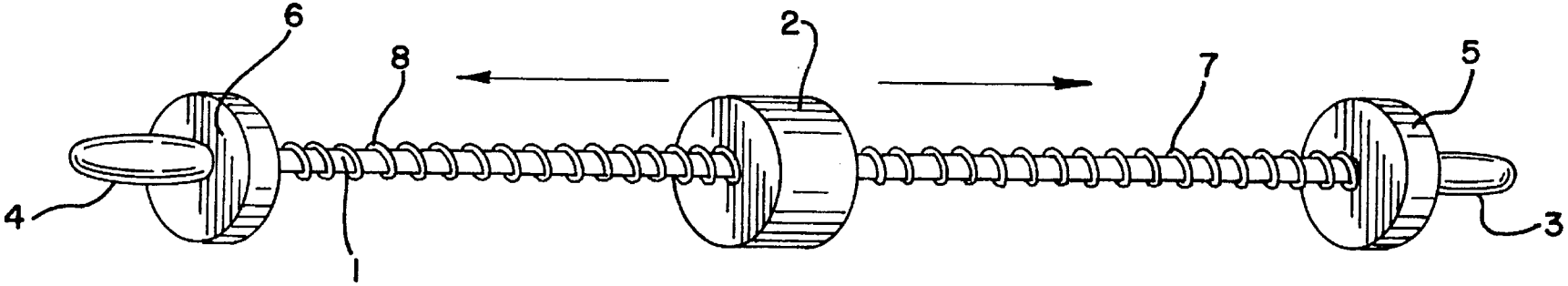
FIG. 1 is an illustration of a reciprocating weight exercise device of the present invention.

An embodiment of a structure made in accordance with the present invention is the reciprocating weight device illustrated in FIG. 1. In this device a rigid rod 1 has a sliding weight 2 on it. The rod can be made of steel, iron, aluminum, or other materials of similar strength, although it is preferred to keep the weight of the rod as light as possible while maintaining the necessary strength. The weight is designed to slide along the length of the rod and can be made of steel, iron, or other similar materials. The weight of the weight can be varied depending upon the strength of the user and the type of the exercise being performed. Typically, weights of one, two, three, and five pounds are used. At each end of the rod are handles 3 and 4. The handles can be made from rubber or other similar material that provides a good grip so that the user's hands will not slip. In particular, the handle material should provide a good grip both when the user's hands are dry and when they are wet from perspiration. The handles are fixed to the rod so they will not come loose during use. To protect the user's hands during use the handles have flanges 5 and 6.

Coil springs 7 and 8 are used to restrict or dampen the sliding motion of the weight. The springs fit around the rod and the ends of the springs abut against the handle and the weight.

To use the device one grasps each handle and moves the rod back and forth in a direction parallel to the length of the rod. This motion causes the weight to slide back and forth along the length of the rod as illustrated by the arrows in FIG. 1. The springs serve to dampen the sliding motion of the weight; thus making the resistance or force felt by the user substantially uniform and substantially limiting the occurrence of any jarring or percussive forces. For example as the weight is sliding towards handle 3, the spring 7 between the handle and the weight will begin to be compressed as soon as the weight leaves the center position. This compression will continue as the distance between the weight and the handle decreases. As the spring becomes more compressed the force it exerts opposing the movement of the weight will gradually increase until the force exerted by the compressed spring is sufficient to stop the movement of the weight towards handle 3 and start it, in conjunction with the force exerted by the user, back towards handle 4. This same effect will then take place on the handle 4 side of the rod. The amount of movement along the rod by the weight will vary depending upon the weight, spring strength and force exerted by the user. Typically, the weight will travel along a majority of the center of the rods length, for example, the distance shown by the arrows in FIG. 1. It is the combination of the force exerted by the user to slide the weight and the resistance provided by the springs that provides the physical conditioning benefits to the user.

Many different types of exercises can be used with the present device. The device can be held horizontally in front of the body with the arms out stretched in a horizontal position. The device can also be held horizontally in front of the body at waist level or above the head.

Additionally, because of the springs, the device can be used in a vertical position. For this type of exercise the rod is held vertically, with one handle above the other and the rod is moved up and down causing the weight to slide up and down. The springs add resistance to the movement of the weight as it is sliding up and slow the movement of the weight as it is sliding down. Additionally, the springs keep the weight in the center position on the rod when the rod is in a vertical position but not being moved. The rod can also be used at any other angle of inclination between horizontal and vertical.

The body parts or muscle groups affected by exercising with the device will depend upon the angle of inclination of the rod, the position of the rod with respect to the body, the amount of weight used, and the tension of the springs used.

The device as well can be used from a sitting position and thus may be beneficial to those confined to a wheelchair. Additionally, the device can be used while standing on one leg to develop balance.

In another embodiment of the present invention one or both of the handles is removable so that the weight and the springs on the rod can be changed. For instance the handle can be threaded or screwed on to the rod.

In another embodiment of the present invention the rigid rod has a handle at one end and a stop member attached to the other end that prevents the spring and weight from sliding off. The handle is designed for easy and secure grasping by one hand, such as the handle of a snow shovel. This embodiment is useful for one handed exercises.

Figure 2:
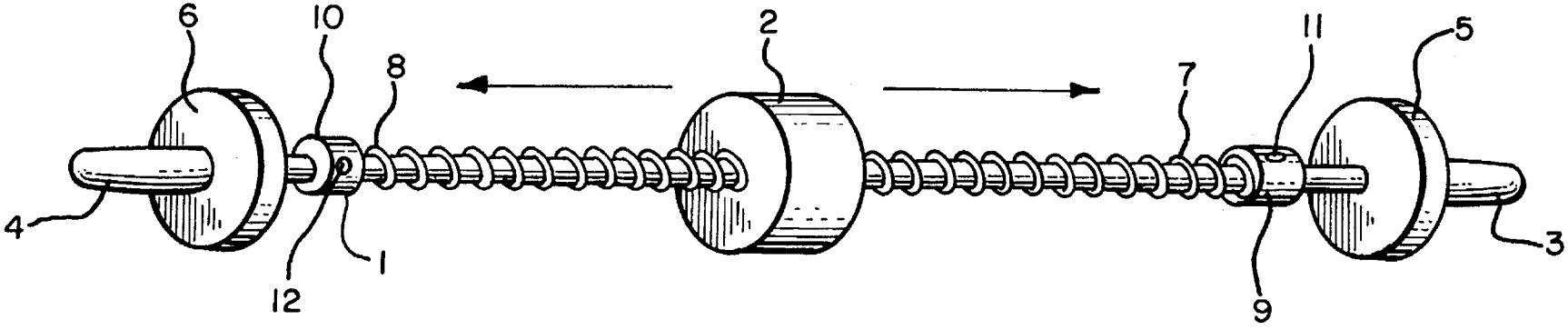
FIG. 2 is an illustration of another embodiment of a reciprocating weight exercise device of the present invention.

Another embodiment of the present invention is illustrated in FIG. 2. In that embodiment adjustable locking rings 9 and 10 are positioned around the rod 1 and between the handles and the end of the springs. The locking rings contain a means for locking the ring 11 and 12. Examples of such locking means are a nut, screw, allen screw or other similar means to prevent the adjustable locking ring from sliding along the length of the bar. Additionally, the screw or bolt can be recessed so that it does not extend above the surface of the adjustable locking ring. The locking rings are used to adjust the spring tension and degree of sliding movement of the weight. Thus, by moving the locking rings closer to the weight the spring tension will be increased and it will require more force to move the weight. A single locking means may also be used in an arrangement in which there is an adjustable locking ring on one side of the weight and a spring on the other side of the weight abutting either a handle or a stop member.

Many variations of the invention suggest themselves to those skilled in the art in view of the above disclosure without departing from the spirit and scope of this invention.

Figure 3A:
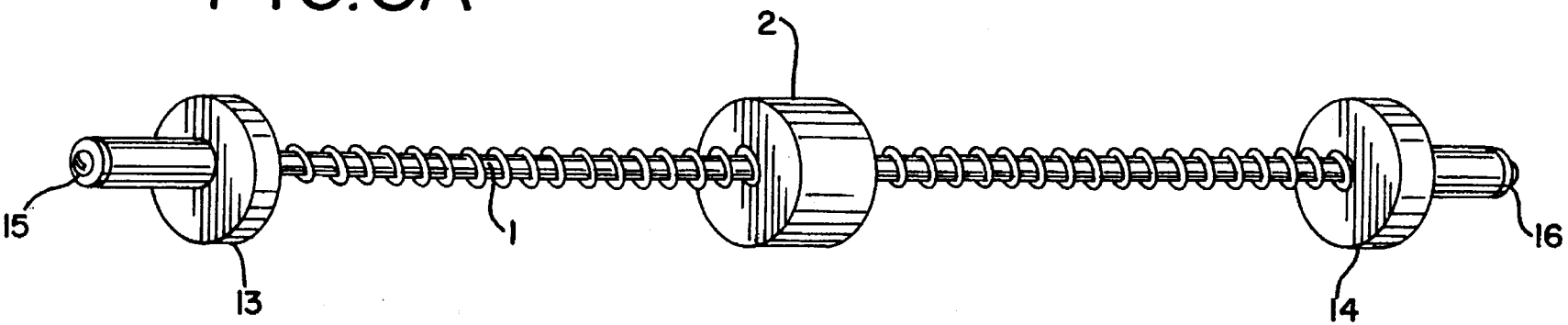
FIGS. 3A and 3B are illustrations of another embodiment of a reciprocating weight exercise device for the present invention.
Figure 3B:
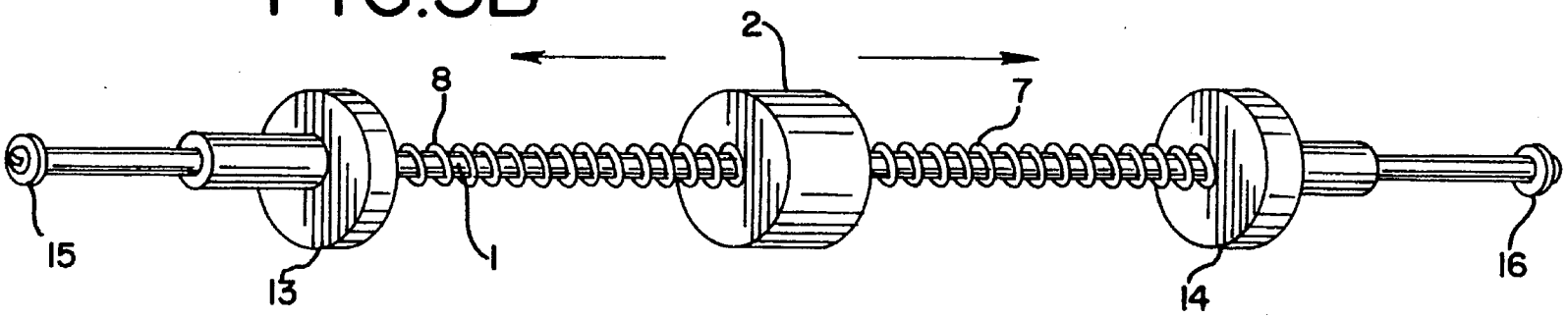

Another embodiment of the present invention is illustrated in FIGS. 3A and 3B. In that embodiment handles 13 and 14 are not fixed to the ends of rod 1, but rather are able to slide along the length of the rod. Restraints 15 and 16 are placed on the rod to prevent the handles from coming off during use. The restraints can be permanent, for example, such as by welding a small amount of metal to the end of the rod, or by flaring the end of the rod to form a flange. The handles can also be removable, for example, such as by the use of a screw and washer (shown in FIG. 3A and 3B). The combination of slidable handles along with the slidable weight and springs, provide for many varied and interesting exercises. Additionally, this embodiment also provides the smooth uniform sensation during use that is provided by the embodiment of FIGS. 1 and 2 as described above. One example of an exercise with this embodiment is sliding both handles 13 and 14 toward the weight 2 compressing springs 7 and 8, as shown in FIG. 3B. While maintaining the handles in the position shown in FIG. 3B the device is then moved back and forth in a reciprocating motion parallel to the length of rod 1. This causes weight 2 to move back and forth as shown by the arrows in FIG. 3B, resulting in the user feeling a smooth uniform sensation as described above. Moreover, the rod remains essentially stationary in relation to the handles. Thus, the rod does not move about to any great extent, leaving the weight and springs as the only parts that have substantial movement during normal use. This use has the additional benefit of requiring the user to continuously compress the springs, providing added isometric type resistance, in addition to the forces created from the sliding movement of the weight. A further example of this embodiment includes a device in which one handle is fixed and one is slidable.

What is claimed:

1. A reciprocating weight exercise device which comprises:

a rod having handles slidably mounted on both sides;

restraints attached to both ends of the rod so that the handles cannot slide off the rod during normal use;

a means for providing a substantially uniform force that is free from jarring and percussive forces during normal use when said rod is moved in a back and forth motion that is parallel to its length;

said means for providing a uniform force comprising:

a first and second coil spring on the rod;

the springs located on opposite sides of a weight mounted on the rod;

one spring abutting against each handle, and both springs abutting against the weight;

the weight being adapted for sliding movement along the majority of the length of the rod, and having sufficient mass to compress the springs during normal use, so that when the weight is slid back and forth along the rod a user will feel a substantially uniform force.

2. The exercise device of claim 1 in which one of the handles is fixed to the rod so that it will not slide during normal use.

3. An exercise device which comprises:

a rigid rod having a first end and a second end;

a first coil spring and a second coil spring;

a weight on said rod;

said weight having a first side and a second side and adapted for sliding movement along said rod;

said weight having sufficient mass to substantially compress the springs during normal use;

a first handle attached to said first end of said rod and a second handle attached to said second end of said rod;

said first side of said weight being disposed toward said first handle and a second side of said weight being disposed toward said second handle;

said first coil spring having a first end and a second end;

said first coil spring located around said rod;

said first end of said first coil spring abutting against said first handle and said second end of said first coil spring abutting against said first side of said weight;

said second coil spring having a first end and a second end;

said second coil spring located around said rod; and said first end of said second coil spring abutting against said second handle and said second end of said second coil spring abutting against said second side of said weight.

4. A reciprocating weight exercise device which comprises:

a rigid rod having a first and a second end;

said rod having a smooth outer surface free from structures along the majority of the center of its length;

a handle attached to said first end of said rod;

a stop member attached to said second end of said rod; and a means for providing a substantially uniform sensation that is free from jarring and percussive forces during normal use when said rod is moved in a reciprocating motion;

said means for providing a uniform sensation comprising:

(i) a single weight on said rod, having a first side and a second side and being adapted for sliding movement along the majority of the length of said rod;

(ii) a first and a second coil spring located around said rod, said springs each having a first and a second end;

(iii) said first end of said first coil spring abutting against said handle and said second end of said first coil spring abutting against said first side of said weight;

(iv) said first end of said second coil spring abutting against said stop member and said second end of said second coil spring abutting against said second side of said weight; and, (v) said weight having sufficient mass to slide back and forth along the rod in a direction parallel to the length of the rod during normal use so that a user will feel a substantially uniform force from the sliding movement of said weight.

5. The exercise device of claim 4 wherein said handle is detachable.

6. The exercise device of claim 4 wherein said stop member is a handle.

* * * * *